US009551340B2

(12) United States Patent
Blank

(10) Patent No.: US 9,551,340 B2
(45) Date of Patent: Jan. 24, 2017

(54) DISPLACEMENT PUMP HAVING FLUIDLY CONNECTED PRESSURE CHAMBERS

(71) Applicant: Joma-Polytec GmbH, Bodelshausen (DE)

(72) Inventor: Andreas Blank, Hechingen (DE)

(73) Assignee: Joma-Polytech GmbH, Bodelshausen (DE)

( * ) Notice: Subject to any disclaimer, the term of this patent is extended or adjusted under 35 U.S.C. 154(b) by 196 days.

(21) Appl. No.: 14/534,580

(22) Filed: Nov. 6, 2014

(65) Prior Publication Data

US 2015/0125331 A1 May 7, 2015

(30) Foreign Application Priority Data

Nov. 7, 2013 (DE) ..... 10 2013 222 597

(51) Int. Cl.
*F03C 4/00* (2006.01)
*F04C 2/00* (2006.01)
(Continued)

(52) U.S. Cl.
CPC ..... *F04C 2/344* (2013.01); *F01C 21/08* (2013.01); *F01C 21/0863* (2013.01); *F04C 2/3442* (2013.01); *F04C 14/06* (2013.01); *F04C 14/18* (2013.01); *F04C 15/0088* (2013.01)

(58) Field of Classification Search
CPC ..... F04C 2/344; F04C 2/3442; F04C 14/06; F04C 14/18; F04C 15/0088; F04C 29/0021; F01C 21/08; F01C 21/0863; F01C 21/0809; F01C 21/0818
(Continued)

(56) References Cited

U.S. PATENT DOCUMENTS 4,354,809 A * 10/1982 Sundberg ..... F01C 21/0809 418/268
4,392,795 A * 7/1983 Smith ..... F01C 21/0809 418/268
(Continued)

FOREIGN PATENT DOCUMENTS

CH 445 006 A 2/1968
DE 25 02 184 A1 7/1976
(Continued)

OTHER PUBLICATIONS

Aug. 19, 2014 German Examination Report for German Application Serial No. 10 2013 222 597.0.

*Primary Examiner* — Theresa Trieu
(74) *Attorney, Agent, or Firm* — Howard & Howard Attorneys PLLC

(57) ABSTRACT

A displacement pump with a pot-shaped housing, a rotor which is swivel-mounted about a rotation axis inside the housing, and two blades which are guided in a movable manner insider the rotor, wherein the pot-shaped housing includes an inner peripheral wall which has a sealing portion for tightly adjoining the rotor and a chamber portion for tightly adjoining the blade tips, as well as for dividing the internal space of the housing into chambers. The rotor has two blade receptacles for receiving and guiding the blades, wherein each internal radially extending blade tip restricts a pressure chamber in the respective blade receptacle. Both pressure chambers are fluid-connected to one another via a connection element, wherein the total volume of both pressure chambers and the connection element remains at the same level during a rotation of the rotor, at least while the blade tips are attached to the chamber portion.

18 Claims, 9 Drawing Sheets

(51) Int. Cl.

| | |
|---|---|
| ***F04C 18/00*** | (2006.01) |
| ***F04C 2/344*** | (2006.01) |
| ***F04C 14/18*** | (2006.01) |
| ***F01C 21/08*** | (2006.01) |
| ***F04C 14/06*** | (2006.01) |
| *F04C 15/00* | (2006.01) |

(58) Field of Classification Search
USPC ..... 418/253–255, 259–260, 266–268, 151
See application file for complete search history.

(56) References Cited

U.S. PATENT DOCUMENTS

| | | | | |
|---|---|---|---|---|
| 4,428,195 | A | 1/1984 | Linder et al. | |
| 4,521,167 | A | 6/1985 | Cavalleri et al. | |
| 4,604,041 | A * | 8/1986 | Hertell | F01C 21/0809 418/268 |
| 5,409,360 | A * | 4/1995 | Wycliffe | F01C 21/0809 418/259 |
| 2008/0159896 | A1 | 7/2008 | Kishi et al. | |
| 2010/0028189 | A1 * | 2/2010 | Cadeddu | F01C 21/0809 418/259 |

FOREIGN PATENT DOCUMENTS

| | | | | |
|---|---|---|---|---|
| DE | 30 15 409 | A1 | 10/1981 | |
| DE | 85 17 622 | U1 | 11/1986 | |
| DE | 28 50 371 | C2 | 12/1988 | |
| DE | 38 20 585 | A1 | 12/1989 | |
| DE | 10 2012 210 048 | A1 | 12/2013 | |
| GB | EP 0597731 | A1 * | 5/1994 | F01C 21/0809 |
| JP | S56-143389 | A | 9/1981 | |

* cited by examiner

DISPLACEMENT PUMP HAVING FLUIDLY CONNECTED PRESSURE CHAMBERS

CROSS-REFERENCE TO RELATED APPLICATION

This application is based upon and claims priority to German Patent Application No. DE 102013222597.0, filed on Nov. 7, 2013.

BACKGROUND OF THE INVENTION

1. Field of the Invention

The present invention relates, generally, to pumps and, more specifically, to a displacement pump.

2. Description of the Related

Conventional displacement pumps known in the art, and in particular hydraulic pumps, typically include a pot-shaped housing, a rotor that is swivel-mounted about a rotation axis inside the housing, and two blades that are guided in a movable manner insider the rotor. The pot-shaped housing includes an inner peripheral wall that has a sealing portion for tightly adjoining the rotor, and a chamber portion for tightly adjoining the blade tips as well as for dividing the internal space of the housing into pressure chambers.

Displacement pumps, which can also be designed as vacuum pumps, can be used in various ways. Especially in motor vehicles, they are used to produce vacuum for brake boosters or hydraulic oil pressure, and are typically driven by the vehicle engine. For example, various displacement pumps have been disclosed in published German Application Nos. DE 2502184A1 and DE 8517622U1.

While displacement pumps known in the related art have generally performed well for their intended purpose, there remains a need in the art for The a displacement pump, in particular a hydraulic pump, that has favorable properties and can be operated with low energy. In addition, there remains a need in the art for a displacement pump that can be disconnected even during operation of the vehicle engine.

SUMMARY OF THE INVENTION

The present invention overcomes the disadvantages in the related art in a displacement pump including a pot-shaped housing, a rotor that is swivel-mounted about a rotation axis inside the housing, and two blades that are guided in a movable manner insider the rotor. The pot-shaped housing includes an inner peripheral wall which has a sealing portion for tightly adjoining the rotor, and a chamber portion for tightly adjoining the blade tips as well as for dividing the internal space of the housing into chambers. The rotor has two blade receptacles for receiving and guiding the blades. Each internal radially extending blade tip restricts a pressure chamber in the respective blade receptacle, and both pressure chambers are fluid-connected to one another via a connection element. A total volume of both pressure chambers and the connection element remains at the same level during a rotation of the rotor, at least while the blade tips are attached to the chamber portion. As a result, both pressure chambers are communicating with one another via the connection element during operation of the displacement pump. The volume by which one of the pressure chambers is decreased corresponds to the volume by which the other pressure chamber is increased. According to the invention, the sum of the volume of both pressure chambers and the connection element, i.e., the total volume, remains at the same level during a rotation of the rotor, at least while the blade tips are attached to the chamber portion and possibly also to the sealing portion of the rotor.

Especially in hydraulic pumps, the pressure chambers may be filled with hydraulic oil to be extracted. Therefore, based on the invention, it is possible to ensure an operation of the pump and movement of both blades with comparatively low losses.

Advantageously, the total volume remains exactly the same during one rotation of the rotor while the pump is in operation. However, realization of maintaining the total volume in operation necessitates great expense. Moreover, during operation of the pump, it is advantageous that during one rotation of the rotor, the total volume lies within the tolerance range of +/−5%, preferably within the tolerance range of +/−2.5%, and even more preferred in a tolerance range of +/−1.5%. Thus, during a complete rotation of the rotor, the total volume changes at a maximum of +/−5%, +/−2.5%, and preferably only +/−1.5% or less. In this respect, according to the invention, the term "remain the same" would indicate a deviation within the above-mentioned tolerance ranges. At the sealing portion, the rotor can be attached tightly along a line extending parallel to the rotation axis of the rotor. In one embodiment, the total volume remains the same during a rotation of the rotor, i.e., when the blade tips tightly adjoin the chamber portion and the sealing portion.

However, it is also possible that the sealing portion of the rotor has a sheetlike design, especially complementary to the rotor. In this way, it is possible to achieve the best possible sealing effect. Then, the sealing portion of the rotor extends particularly concentric to the lateral area of the rotor and extends over a rotation angle range of the rotor of between 2.5° and 15° and especially over a rotation angle range of between 5° and 10°. When passing through this rotation angle range with a blade tip, the total volume can increase and again decrease by between +2.5% and +15%, preferably by between +5% and +10%, and even more preferred by between +7.5% and +10%.

Advantageously, during operation of the displacement pump, the total volume is filled with a liquid lubricant, in particular hydraulic oil. In this way, it is possible to achieve adequate lubrication of the rotor blades, as well as to ensure sufficient sealing effect.

To improve the formation of the pressure chambers, the blade tips extending radially to the inside may have clearances and/or recesses, which preferably extend over the entire transverse extension of the blades, i.e., parallel to the rotation axis of the rotor.

Advantageously, both blade receptacles may be arranged in the rotor in parallel fashion to one another and are open toward the internal space of the housing on the sides facing away from one another. As a result, on these open sides, the blades can protrude from the rotor and form the chambers in the internal space. At the same time, a partition has been provided between the blade receptacles in the rotor, whereby the partition includes the connection element via which the two pressure chambers communicate with one another. In particular, the connection element can be designed as a cut-out in the area of the partition, as an insection, a recess, or a drill hole in the partition.

In one embodiment, the front sides of the blades facing each other are designed to align with the rotor in axial direction, wherein the partition can involve a recess which forms the connection element and which is moved back in axial direction. In particular, the recess can extend over the entire length of the partition, i.e., cover the area located between the two blades. At the same time, the recess can include a depression further moved back in axial direction in which a locking mechanism can be provided via which the blades can be locked in position, especially when retracted. To lock the blades in position, especially when retracted, is especially important when the displacement pump is not supposed to supply any low pressure, whereas the displacement pump, or its rotor, is still rotating in the housing. In addition, in the radially internal space, the blade receptacles can have a clearance extending in axial direction. In this way, it is possible to provide a space in which lubricant can be accumulated, even when the blade assumes its radially retracted position.

To improve the communication between both pressure chambers, it is advantageous when the front sides of the blades, which extend transversal to the rotation axis, have a recess in the radially internal space. As a result, the flow cross-section of the lubricant can be increased from the pressure chamber of the one blade receptacle to the pressure chamber of the other blade receptacle. In this way, the flow resistance of the lubricant, which flows back and forth in the total volume, is reduced. In particular, the recess can have a step-like design and include a first wall section extending parallel to the rotation axis and a second wall section extending transversal to the rotation axis. This cuts out the "rear corner" of the respective blade.

Furthermore, it is advantageous when a third slanted wall section is attached to the second radially internal wall section. In particular, the blade and/or the rotor have a symmetric design so that the two radially internal corners of the blade are cut out. In one embodiment, the connection elements are provided at the areas of the rotor or its partition that extend axially to the outside.

In order to further improve the flow of the lubricant from one pressure chamber to the other pressure chamber, it is advantageous that the first wall section of the respective blade extend transversal to the normal condition of the blade, which provides an expansion of the recess toward the other blade. Because of the inclined arrangement of the wall section, it is possible to achieve an improved flow of the lubricant, as well as adequate stability for the respective blade. Advantageously, when the blades have a symmetric design, both first wall sections of the respective blade are extending in correspondingly transverse manner. In one embodiment, the second wall section extends in axial direction aligned with the connection element, especially with the recess of the partition.

To improve the distribution of the lubricant inside the rotor, it is advantageous to provide balancing holes between the front sides of the blades extending transversal to the rotation axis. Preferably, the balancing holes may extend over the entire width of the blade. Furthermore, oil grooves may be provided at the front sides of the blades facing each other, whereby the oil grooves extend in radial direction. The oil grooves can contain lubricant. When the blades are provided with drill holes, it conceivable that the drill holes may open into the oil grooves.

In one embodiment, weights may be provided in the radially internal area of the blades for shifting the center of gravity of the blades. In particular, the weights can be designed in such a way that the blades assume a radially internal position when the lubricant supply is turned off, i.e., when the total volume is running dry. As a result, no low pressure is provided. The pump is no longer performing and the rotor can have an energy-efficient rotation. Only when low pressure performance is resumed, it is possible to continue the lubricant provision, so that the total volume is filled with lubricant and the blades assume a radially external position. In this position, a respective pump performance can be provided.

Moreover, to provide adequate lubrication and seal of the pump, it is possible that through-holes are provided in the rotor as extensions of the blade receptacles. Through these drill holes lubricant from the respective pressure chamber can flow into the internal space of the pump.

BRIEF DESCRIPTION OF THE DRAWINGS

Other objects, includes, and advantages of the present invention will be readily appreciated as the same becomes better understood after reading the subsequent description taken in connection with the accompanying drawing wherein.

DETAILED DESCRIPTION OF THE INVENTION

Figure 1:
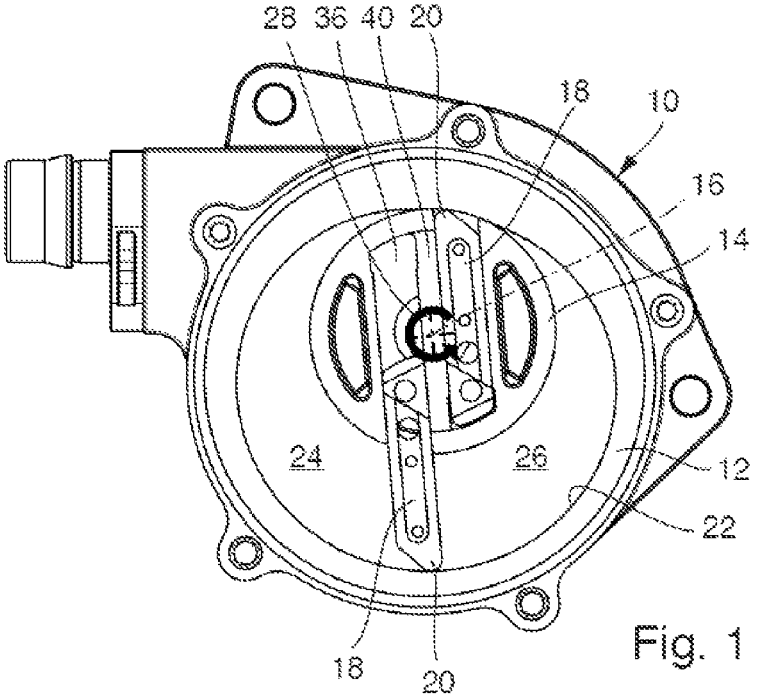
FIG. 1 shows a cross-section through a displacement pump in operation according to one embodiment of the present invention.
Figure 2A:
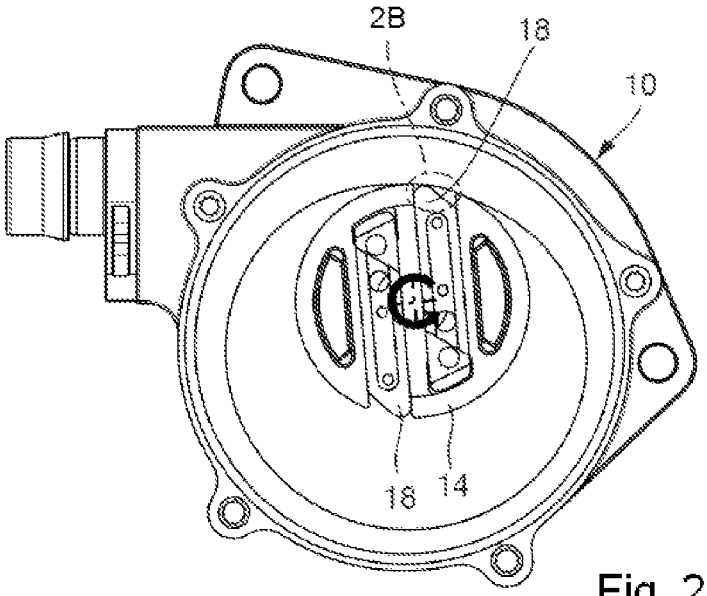
FIG. 2A shows the cross-section of FIG. 1 with a disconnected displacement pump.

With reference now to the drawings, FIGS. 1 and 2A show a displacement pump 10 with a pot-shaped housing 12. In the housing 12, a rotor 14 is swivel-mounted about a rotation axis 16. In the rotor 14, two blades 18 are guided in a movable manner, the blade tips 20 of which adjoin the inner peripheral wall 22 of the housing 12 and divide the internal space of the housing 12 into chambers 24, 26, when the displacement pump 10 is in operation, as shown in FIG. 1. When the rotor is rotated in the direction indicated in FIG. 1 by arrow 28, the chamber 24 forms a suction chamber and chamber 26 forms a discharge chamber.

In FIG. 2A, the displacement pump is disconnected, wherein the rotor 14 which, in particular, can be linked in rotary fashion with an engine, continues to rotate. The blades 18 are in a retracted position. Because the blades 18 are not divided into a suction chamber and a pressure chamber (rather, the individual chambers are interconnected), the pump is not performing in this condition.

Figure 2B:
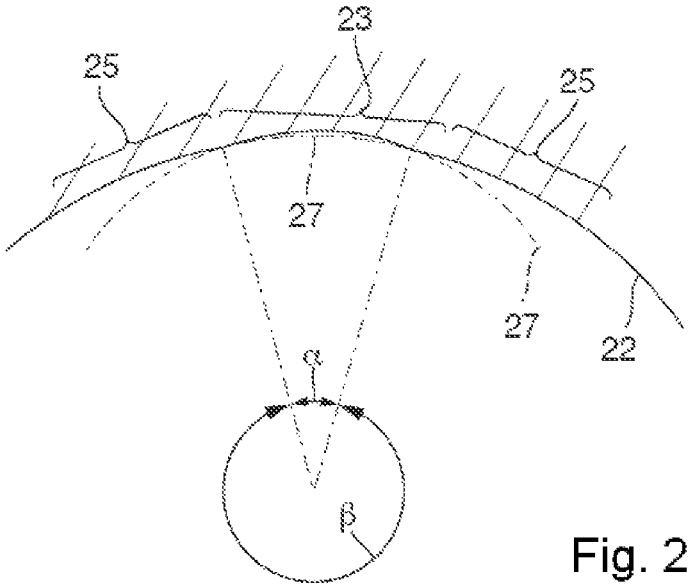
FIG. 2B shows an enlarged view of indicia 2B of FIG. 2A.

Referring now to FIG. 2B, which shows an enlarged view of indicia 2B shown in FIG. 2A, the inner peripheral wall 22 has sealing portion 23 for tightly adjoining the rotor 14 and a chamber portion 25 for tightly adjoining the blade tips. The sealing portion 23 extends over an angle $\alpha$ of approximately 15° and is concentrically disposed to the rotor 14, forming a sealing surface with the rotor 14. In FIG. 2B, the lateral surface of the rotor 14 is represented by a dotted line and has the reference numeral 27. The virtual surface of the inner peripheral wall 22 is represented by a dot-dashed line and has the reference numeral 27, which is, however, recessed from the sealing portion 23 of the rotor. As a result, the chamber portion 25 extends over an angular range β, wherein it applies: β=360°-α (for example, β=approximately 345°). In one embodiment of the invention, it is also possible that the sealing portion of the rotor does not extend over a surface, but along a line which extends parallel to the rotation axis. In this case, the angle α is equal to zero.

Figure 3A:
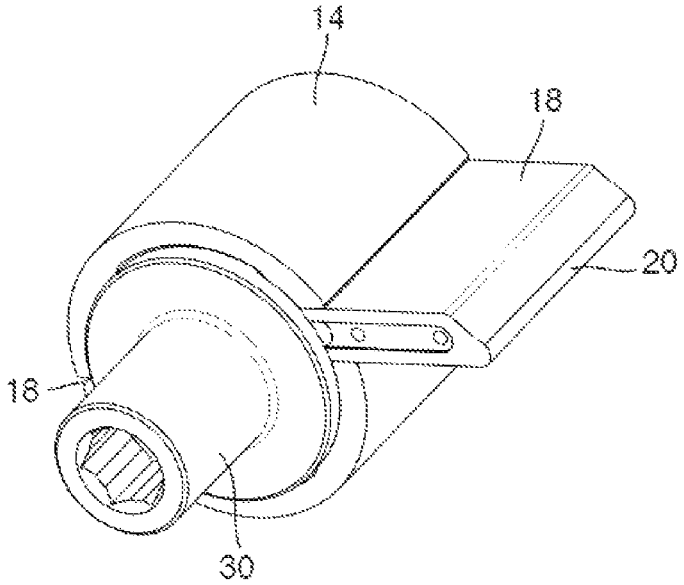
FIG. 3A shows a perspective view of a rotor of the pump, including blades.
Figure 3B:
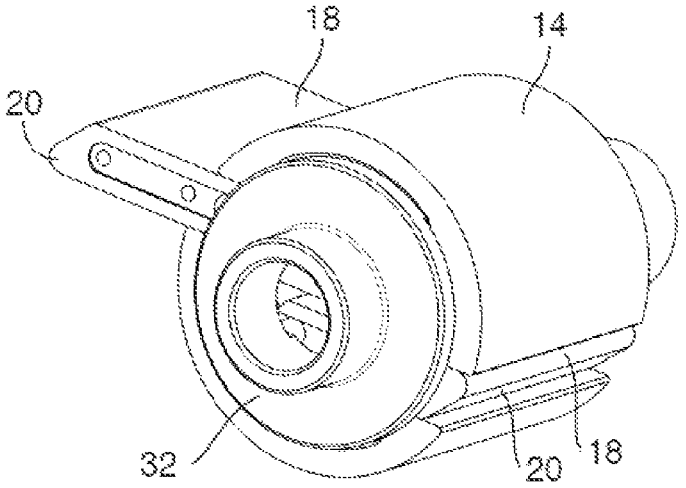
FIG. 3B shows a rear view of the rotor of FIG. 3A.

FIGS. 3A and 3B show the rotor 14 with the two blades 18 as an individual part. FIG. 3A shows a drive shaft 30, which rotates the rotor 14. In the opposite view shown in FIG. 3B, a counter bearing 32 is shown.

Figure 4:
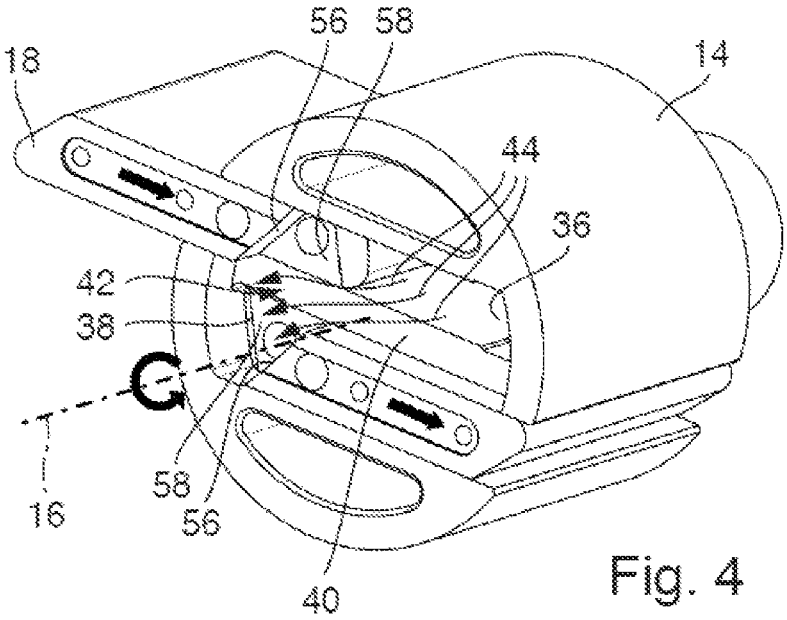
FIG. 4 shows a top view of the rotor of the pump according to FIGS. 1-3B.

As shown in FIG. 4, the individual blades 18 are each arranged in a movable manner in a blade receptacle 34, wherein the internal radially extending blade tips respectively restrict a pressure chamber 36, 38 in the blade receptacles 34. Between the two blades 18, or between the two pressure chambers 36, 38, the rotor provides a partition 40, which is moved back in axial direction, thus forming a connection element 42 between both pressure chambers 36 and 38.

In operation, the pressure chambers 36, 38 and the connection element 42 are filled with hydraulic oil. The displacement pump 10 is designed in such a way that the total volume of both pressure chambers 36, 38 and the connection element 42 is maintained during a rotation of the rotor. As shown in FIG. 1 and FIG. 4, during a rotation of the rotor, the initially extended blade is moved to the inside while, at the same time, the internal initially radially retracted blade 18 moves radially to the outside. To that end, the rotor 14 with the blades 18 and the inner peripheral wall 22 have a respective design. As a result, both pressure chambers 36 and 38 correspond with one another such that the hydraulic oil can flow back and forth between the pressure chambers 36, 38 when the pump is operating. In FIG. 4, the flow of the hydraulic oil is indicated by the arrows 44.

Figure 12:
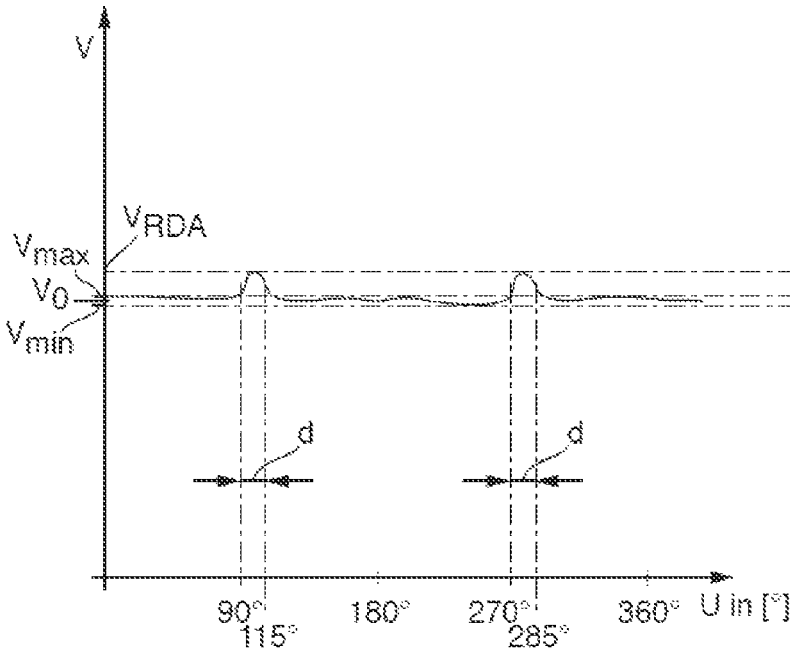
FIG. 12 depicts total volume of the pump during rotation of the rotor.

During the rotation of the rotor 14, the total volume of the pressure chambers 36, 38 and the connection element 42 remains the same at least in chamber portion 25. Thus, it is possible to achieve a low-loss operation of the pump. Advantageously, during one rotation of the rotor, the total volume lies within the tolerance range of +/−2.5%. This is indicated in FIG. 12, wherein on one axis the rotation angle of the rotor is outlined in degrees (°). At 360°, the rotor rotates once. On the other axis, the total volume V is outlined, which is shown in starting position $V_0$ with the rotor 14 shown in the drawings. During one rotation of the rotor 14, the total volume changes in the range between $V_{min}$ and $V_{max}$, wherein $V_{min}$ and $V_{max}$ lies in the range of +/−2.5% of $V_0$. As a result, during one rotation of the rotor 14, the total volume remains the same within the tolerance range.

Only in the regions in which the blade tips switch from the chamber portion 25 to the sealing portion 23 of the rotor, the volume increases temporarily to the value $V_{RDA}$. $V_{RDA}$ lies in the range of $V_{RDA}=V_0+10\%$. In the event that the sealing portion 23 of the rotor does not extend over a surface but, instead, along a line, the volume is not increased to the value $V_{RDA}$. In this case, the total volume remains the same during a complete rotation.

Figure 5:
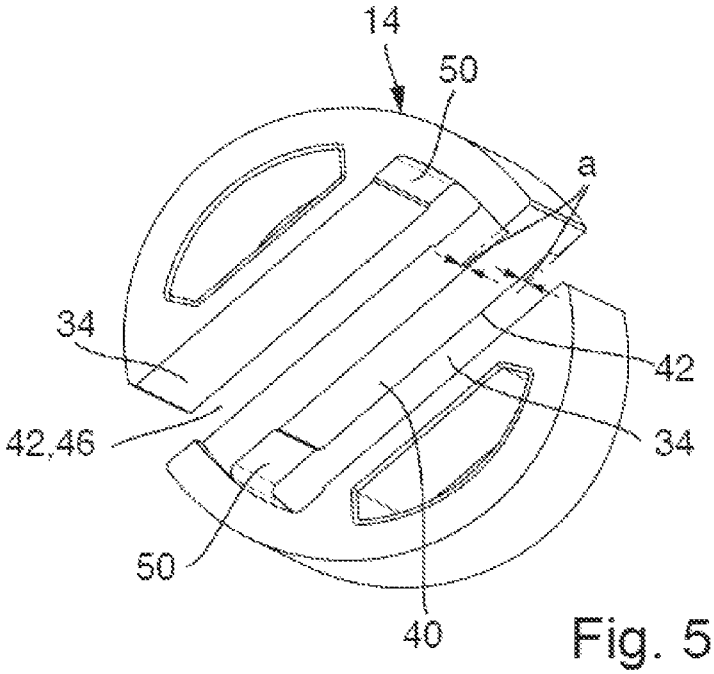
FIG. 5 shows an alternate view of the rotor.
Figure 6:
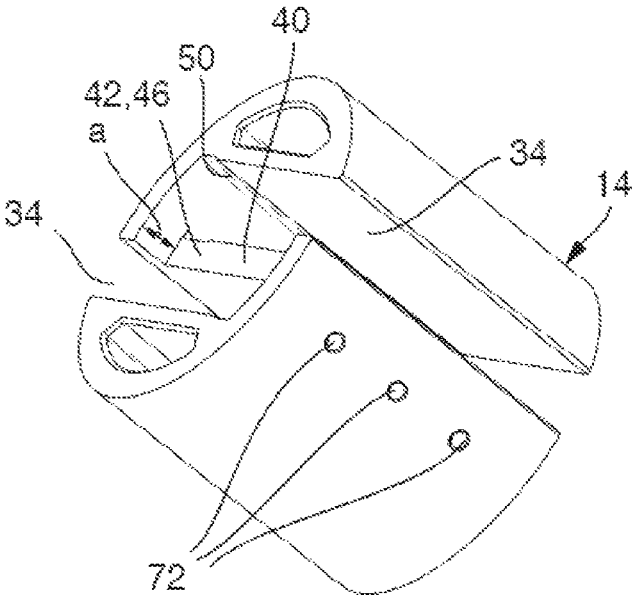
FIG. 6 shows another alternate view of the rotor.
Figure 7:
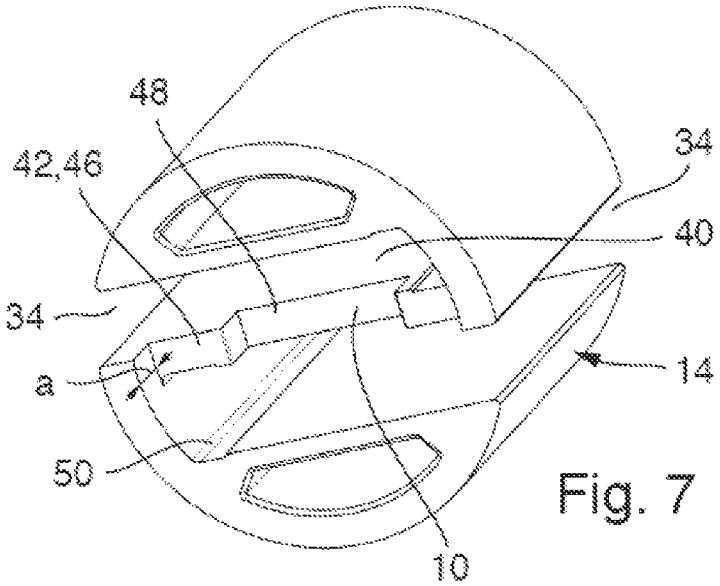
FIG. 7 shows an alternative embodiment of the rotor.

As shown in FIGS. 5-7, both blade receptacles 34 are arranged parallel to one another in the rotor 14 and on the sides facing away from each other such that they are open toward the internal space. Between the two blade receptacles 34, the partition has been arranged, which is moved back in axial direction on both sides of the rotor by the value a in order to form the connection element 42. This provides a recess 46, which forms the connection element 42.

In the rotor shown in FIG. 7, the recess 46 has a depression 48 which is further moved back axially, into which a radial locking mechanism can be inserted. For example, such a locking mechanism can further suspend the blades 18 in their retracted position, such that the pump shown in FIG. 2A is not performing.

In particular, FIGS. 5-7 show that the blade receptacles 34 have, in their radially internal areas, a clearance 50 extending in axial direction which expand the blade receptacles. The clearance 50 ensures that, even when the blade 18 is completely retracted, a portion of hydraulic oil remains in the respective pressure chamber 36, 38.

FIG. 6 shows that through-holes 72 may be provided in the rotor 14 as extensions of the blade receptacles 34. The through-holes 72 have a comparatively small diameter so that only a small amount of hydraulic oil can escape. As a result, it is ensured that the rotor 14 and the inner peripheral wall 22 are covered with an oil film, which contributes to the sealing of the chambers 24, 26.

Figure 8:
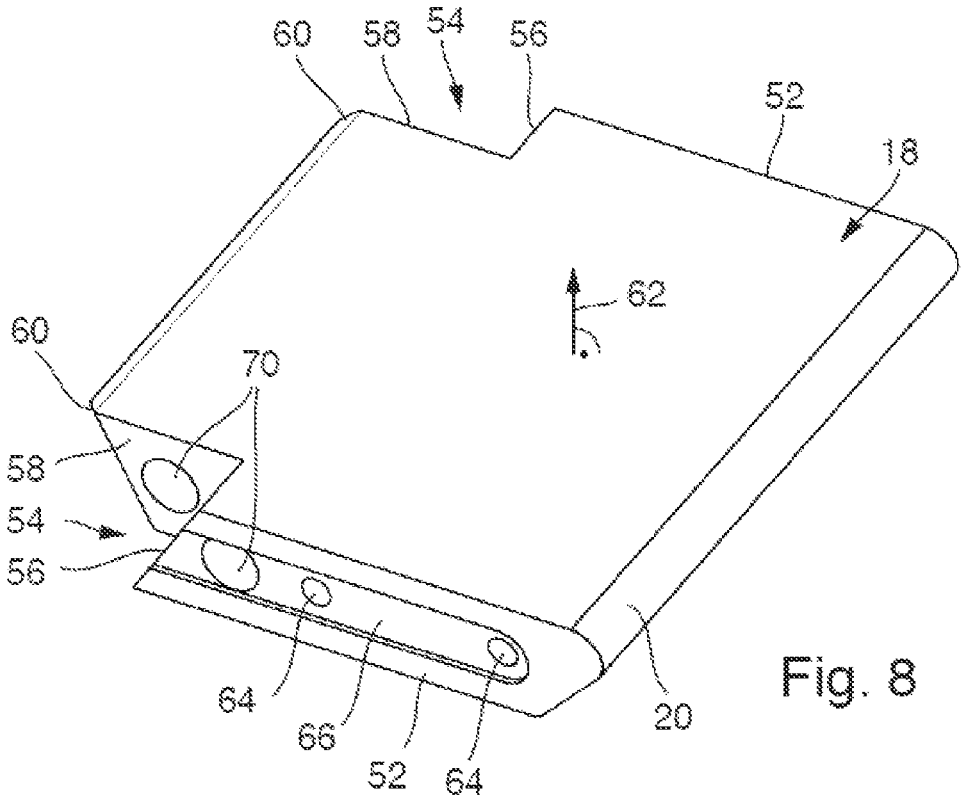
FIG. 8 shows an exploded view of one blade of the pump.

FIGS. 8 and 9 show that the front sides 52 of the blades 18, which extend transversal to the rotation axis, have two step-like recesses 54 in the radially internal space. The recesses 54 provide a first wall section 56 extending parallel to the rotation axis and a second wall section 58 extending vertically to the first wall section. In the radially internal space, the second wall section 58 is adjoined by a third wall section 60 extending transversal to the second wall section. A top view in FIG. 9 shows that the first wall section 56 extends transversal to the normal condition of the blade 62. In this way, it is possible to keep the flow cross-section comparatively large in the area adjoining the connection element 42, because the particular recess 54 of the respective blade 18 is expanded up to the connection element 42, which is represented in FIG. 4. This results in favorable flow conditions so that hydraulic oil can flow from one pressure chamber 36 to the other pressure chamber 38 when the pump is operating.

Figure 9A:
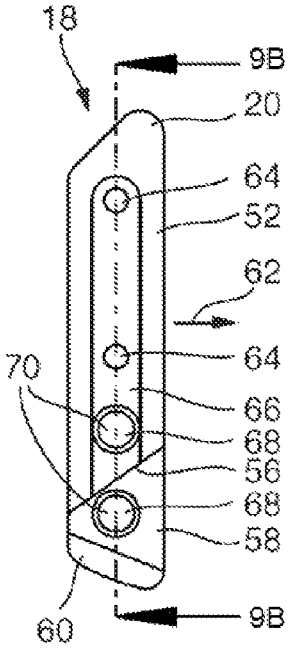
FIG. 9A shows a top view on the front side of one blade.
Figure 9B:
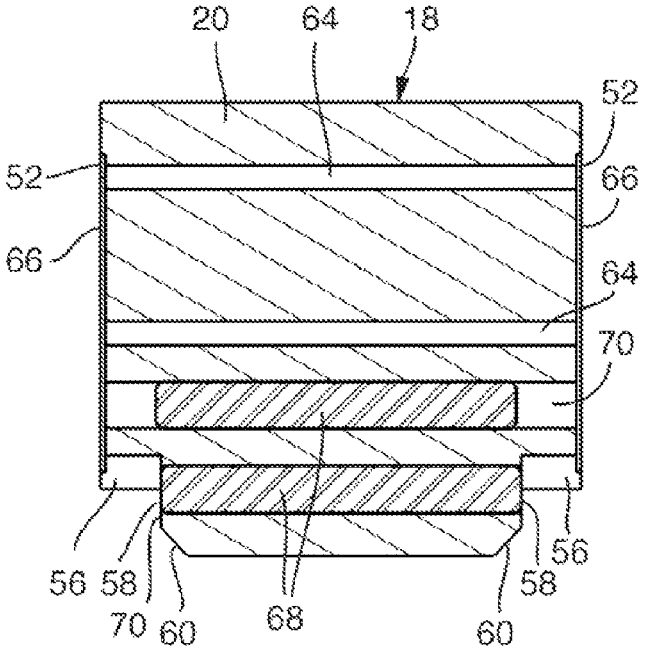
FIG. 9B shows a longitudinal section through the blade taken along line 9B-9B of FIG. 9A.

FIG. 9A shows a top view on the front side 52 of the blade 18, and FIG. 9B shows a section of the blade 18 taken along line 9B-9B of FIG. 9A. FIG. 9B shows that two balancing holes 64 are provided between the front sides 52 extending transversal to the rotation axis in the blade. These balancing holes 64 are used for equalizing the pressure that is prevalent in the region of the front sides 52. FIGS. 8-9B show that the front sides 52 also have oil grooves 66 extending in radial direction. The oil grooves 66 are closed in the region of the blade tip 20, and open toward the recess 54 in the radially internal space. Each balancing hole 64 opens into the respective oil groove 66. In the radially internal space, two pin-shaped weights 68 are arranged in the blades in specifically provided drill holes 70. In this way, the center of gravity of the blades is shifted to the radially internal space of the blades 18.

Figure 10:
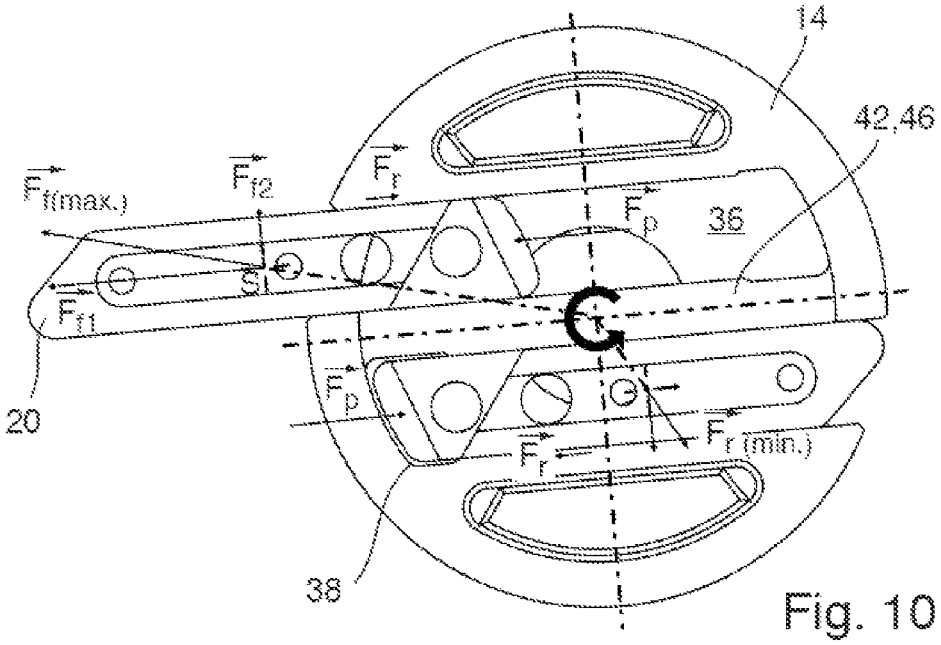
FIG. 10 shows the rotor and blades of the pump in operation.

FIG. 10 shows the force exerted on the blades when the pump 10 is operating. When the pump 10 is operating, an oil pressure, which results in oil-fired power $F_P$, is applied in the pressure chambers 36, 38, which are connected with one another via the connection element 42 or the recess 46. This power is effective to the outside. A frictional force $F_r$ is active in opposite direction, which has to be overcome in radial direction to the outside in order to move the blades. Because of the rotation of the rotor 14, a centrifugal force $F_f$ is also exerted on the blades. This centrifugal force $F_f$ is split into a force component $F_{f1}$ acting in the direction of the power $F_P$, and a second force component $F_{f2}$ acting perpendicular to it. At the same time, the centrifugal force $F_f$ engages at the center of gravity S of the blade 14. When the pump 10 is operating, the sum of $F_P$ and $F_n$ is greater than the force $F_r$; thus the blade is pushed into its extended position and acts with its tip 20 against the inner peripheral wall 22 of the housing 12.

Figure 11:
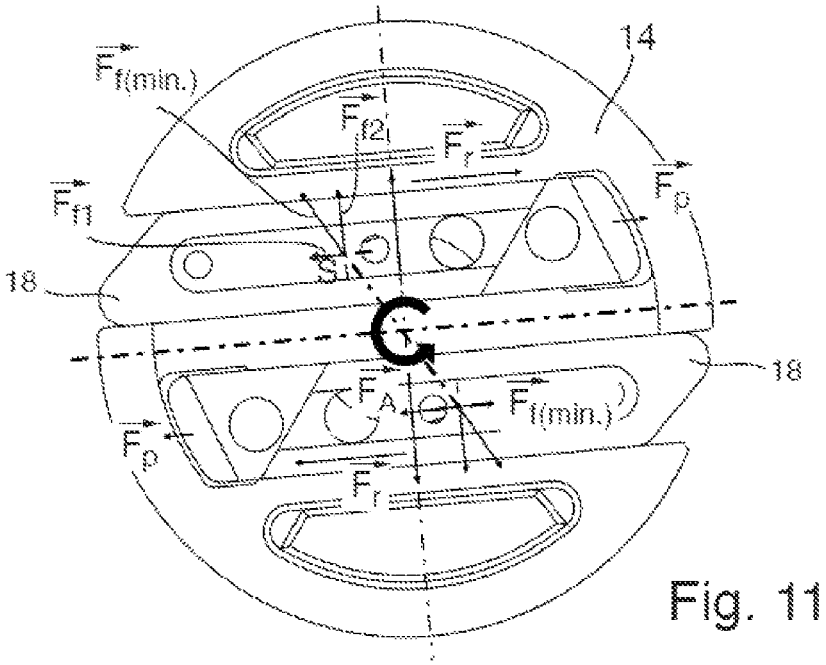
FIG. 11 shows the rotor and blades with disconnected pump.

FIG. 11 shows the respective forces with a rotating rotor 14, however, the supply of hydraulic oil into the pressure chambers 36, 38 is interrupted. Because of the resulting low pressure, the oil pressure $F_P$ is reversed. In addition, the friction force $F_r$ is increased because the lubrication of the blades 18 in the rotor is reduced. Moreover, when the rotor is rotating, the blades are moved into the rotor because they glide along the inner peripheral wall 22. In particular, because the center of gravity of the blades 18 is located comparatively far back, the force $F_{f1}$ in the direction of the blade receptacles 34 resulting from the centrifugal force $F_f$ is comparatively small. The friction force $F_r$ and the low pressure $F_p$ are greater than the resulting centrifugal force $F_{f1}$. This results in a locking force $F_A$, which pushes the respective blade 18 into the blade receptacle 34. As a result, the blades 18 are retained in the rotor 14, and the rotor 14 rotates without performing.

The invention has been described in an illustrative manner. It is to be understood that the terminology which has been used is intended to be in the nature of words of description rather than of limitation. Many modifications and variations of the invention are possible in light of the above teachings. Therefore, within the scope of the appended claims, the invention may be practiced other than as specifically described.

What is claimed is:

1. A displacement pump comprising: a pot-shaped housing, a rotor swivel-mounted about a rotation axis inside the housing, and two blades guided in a movable manner insider the rotor, wherein the pot-shaped housing includes an inner peripheral wall having a sealing portion for tightly adjoining the rotor, and a chamber portion for tightly adjoining the blade tips and dividing the internal space of the housing into chambers, wherein the rotor has two blade receptacles for receiving and guiding the blades, wherein each internal radially extending blade tip restricts a pressure chamber in the respective blade receptacle, and both pressure chambers are fluid-connected to one another via a connection element, wherein a total volume of both pressure chambers and the connection element remains at the same level during a rotation of the rotor, at least while the blade tips are attached to the chamber portion, wherein both blade receptacles are arranged in the rotor parallel to one another and opposite to each other and are open toward the internal space of the housing on the sides facing away from one another and are closed towards the internal space of the housing on the respective other sides, wherein a partition is provided between the two blade receptacles in the rotor extending transverse to the rotational axis to partition the blade receptacles, and wherein the partition includes the connection element.

2. The pump as set forth in claim 1, wherein during one rotation of the rotor the total volume remains within a tolerance range of +/−5%.

3. The pump as set forth in claim 1 wherein the sealing portion of the rotor is concentrically disposed to the rotor and forms a sealing surface with the rotor, wherein when passing through the sealing portion with a blade tip, the total volume increases and subsequently decreases by between +2.5% and +15%.

4. The pump as set forth in claim 1, wherein front sides of the blades, which extend transversal to the rotation axis, are aligned with the rotor, wherein the partition provides a recess which forms the connection element and which is moved back in axial direction.

5. The pump as set forth in claim 4, wherein a second wall section is aligned with the recess of the partition.

6. The pump as set forth in claim 1, wherein the blade receptacles in the radially internal space have a clearance extending in axial direction.

7. The pump as set forth in claim 1, wherein front sides of the blades, which extend transversal to the rotation axis, have a recess in the radially internal space.

8. The pump as set forth in claim 7, wherein the recess includes a first wall section extending parallel to the rotation axis and a second wall section extending transversal to the rotation axis.

9. The pump as set forth in claim 8, wherein the recess has a slanted third wall section, which is attached to a second radially internal wall section.

10. The pump as set forth in claim 7, wherein the first wall section of the respective blade extends transversal to a normal condition of the blade, so as to provide an expansion of the recess toward the other blade.

11. The pump as set forth in claim 1, wherein balancing holes are provided between front sides of the blades extending transversal to the rotation axis.

12. The pump as set forth in claim 1, wherein at front sides of the blades facing each other oil grooves are provided, which extend in radial direction.

13. The pump as set forth in claim 1, wherein weights are provided in the radially internal area of the blades for shifting the center of gravity of the blades.

14. The pump as set forth in claim 1, wherein the rotor has through-holes as extensions of the blade receptacles.

15. The pump as set forth in claim 1, wherein during one rotation of the rotor, the total volume remains within a tolerance range of +/−2.5%.

16. The pump as set forth in claim 1, wherein during one rotation of the rotor, the total volume remains within a tolerance range of +/−1.5%.

17. The pump as set forth in claim 1, wherein the sealing portion of the rotor is concentrically disposed in relation to the rotor and forms a sealing surface with the rotor, wherein when passing through the sealing portion with a blade tip, the total volume increases and subsequently decreases by between +5% and +10%.

18. The pump as set forth in claim 1, wherein the sealing portion of the rotor is concentrically disposed in relation to the rotor and forms a sealing surface with the rotor, wherein when passing through the sealing portion with a blade tip, the total volume increases and subsequently decreases by between +7.5% and +10%.

* * * * *